US005426840A

United States Patent [19]

Funaya

[11] Patent Number: 5,426,840

[45] Date of Patent: Jun. 27, 1995

[54] METHOD AND APPARATUS FOR ATTACHING A SLIDER PULL TAB

[75] Inventor: Kazuhiro Funaya, Kurobe, Japan

[73] Assignee: YKK Corporation, Tokyo, Japan

[21] Appl. No.: 291,495

[22] Filed: Aug. 17, 1994

[30] Foreign Application Priority Data

Aug. 24, 1993 [JP] Japan ..... 5-241919

[51] Int. Cl.[6] ..... B41H 37/06; B21D 53/50

[52] U.S. Cl. ..... 29/409; 29/766; 29/407; 29/33.2

[58] Field of Search ..... 29/408, 409, 766, 33.2, 29/407

[56] References Cited

U.S. PATENT DOCUMENTS

| | | | |
|---|---|---|---|
| 2,354,690 | 8/1944 | Lawson | 29/409 |
| 2,693,217 | 11/1954 | Lange | 29/409 |
| 2,825,126 | 3/1958 | Legat et al. | 29/409 |
| 4,051,710 | 10/1977 | Kobayashi | 72/410 |
| 5,031,307 | 7/1991 | Yoneda et al. | 29/766 |
| 5,067,221 | 11/1991 | Oyama | 29/766 |
| 5,174,017 | 12/1992 | Hatagishi | 29/766 |

*Primary Examiner*—P. W. Echols

*Attorney, Agent, or Firm*—Hill, Steadman & Simpson

[57] ABSTRACT

An apparatus for attaching pull tabs automatically one at a time onto a slider body comprises a pull tab transport unit, a clamper applying unit and a clamping unit. The transport unit includes a pull tab transfer chute having a pair of elongate horizontal guide rails defining therebetween a guide slit along which a series of pull tabs are fed for attachment one at a time onto sliders transferred along a horizontally extending chute. A clamper pusher is provided for moving a clamper of the slider pivotally through 90° to lie substantially parallel with the guide slit of the pull tab chute. A transfer conveyor operatively associated with the clamper applying unit is movable along a rectangular path to move and set the pull tab in position for connection and clamping with the slider.

7 Claims, 5 Drawing Sheets

METHOD AND APPARATUS FOR ATTACHING A SLIDER PULL TAB

BACKGROUND OF THE INVENTION

1. Field of the Invention

This invention relates to a method of and an apparatus for attaching a pull tab onto a slider body to provide a slide fastener slider substatially in an automated cycle of operation.

2. Prior Art

There have been proposed numerous devices for attaching pull tabs to associated slider barrels which are separately fabricated.

To the best of the inventors' knowledge, such pull tab attachment devices known to date were manually operated as exemplified for instance in Japanese Utility Model Publication No. 56-37611 which discloses clenching a pull tab to a ring member on a slider body with use of a manual clamping tool.

Such conventional pull tab attachment operation by hand was not only literally time-consuming and tedious, but also would entail difficulty in achieving a uniform and neat finish of the joint between the pull tab and the slider body.

SUMMARY OF THE INVENTION

With the foregoing difficulties of the prior art in view, the present invention seeks to provide a novel method of and an apparatus for attaching a pull tab to its associated slider body substantially automatically with utmost efficiency and accuracy.

This and other objectives and features of the invention will became apparent from the following detailed description taken in connection with the accompanying drawings.

According to one aspect of the invention, there is provided a method of attaching a pull tab onto a slider body which comprises the steps of;

(a) feeding a series of pull tab intermittently one at a time along a horizontal path of travel with an opening in a coupling link of each pull tab oriented to face upward;

(b) feeding a series of unclamped sliders intermittently one at a time along a separate horizontal path of travel above the horizontal path of pull tabs, with a clamper vertically suspended from each slider body;

(c) lifting the clamper pivotally to lie substantially horizontally parallel with respect to the horizontal path of travel of the pull tabs;

(d) connecting the clamper through the link opening to the pull tab;

(e) clamping the slider together with the pull tab by closing the link opening and;

(f) withdrawing the clamped slider past the horizontal path of the pull tabs for storage.

According to another aspect of the invention,there is provided an apparatus for attaching a pull tab substantially automatically onto a slider body which comprises a pull tab transport unit, a clamper applying unit and a clamping unit; the pull tab transport unit including a pull tab transfer chute having a pair of elongate horizontal guide rails 16a and 16b defining therebetween a longitudinal guide slit for receiving a series of pull tabs and a transfer conveyor movable reciprocally along a rectangular path to transfer the pull tabs intermittently one at a time through the chute; the clamper applying unit including a horizontally extending slider supply chute, a slider holder vertically movable toward and away from the pull tab transfer chute, a slider carriage horizontally movable to transfer a series of sliders one at a time over to the slider holder, each of the sliders having a clamper vertically suspended therefrom, and a clamper pusher vertically movable to lift the clamper pivotablly through approximately 90° to lie substantially parallel with the guide slit; and the clamping unit including a clamping punch for clamping the pull tab together with the slider.

DETAILED DESCRIPTION OF THE INVENTION

Figure 1:
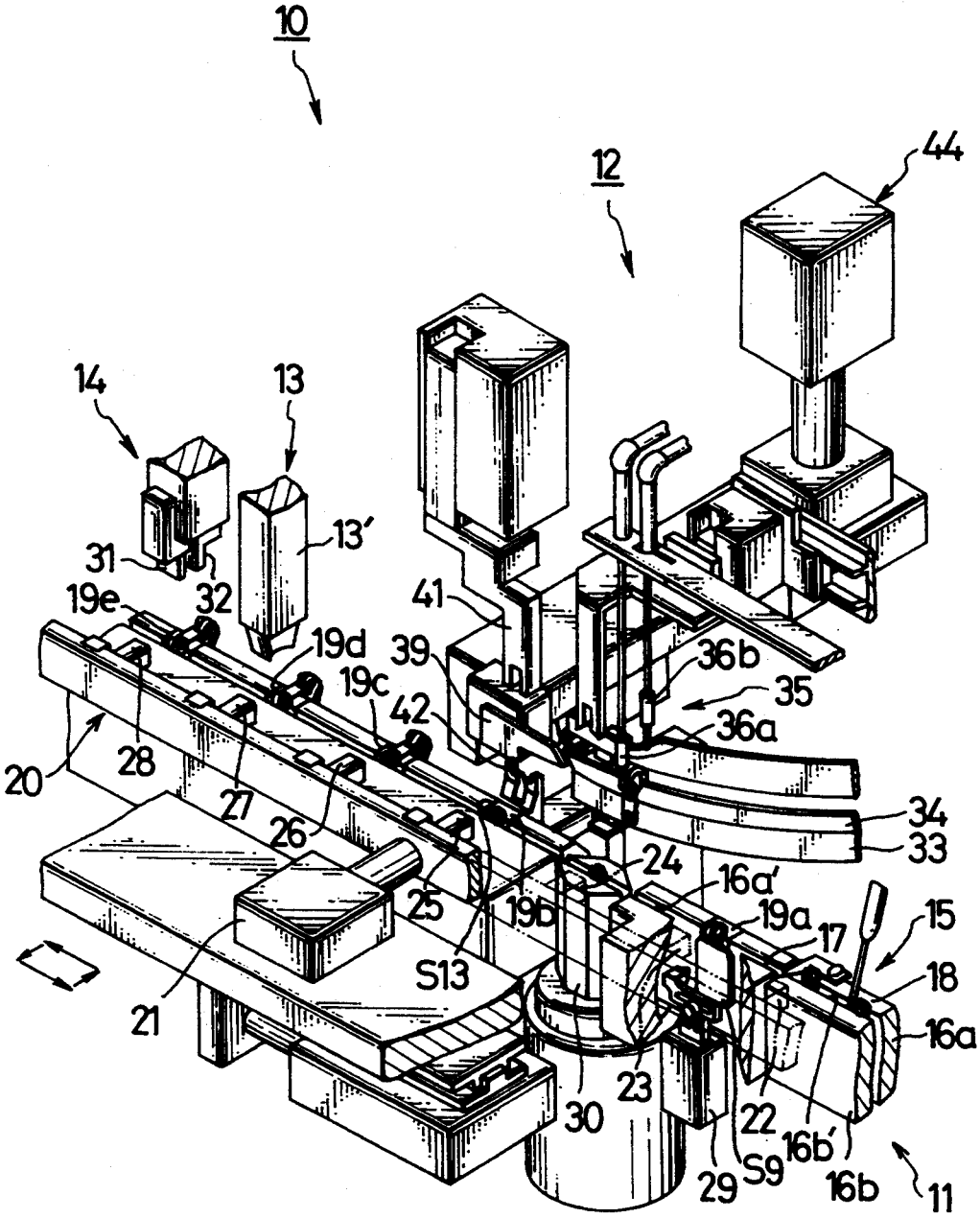
FIG. 1 is a perspective view of a pull tab attachment apparatus embodying the invention.

Referring now to the drawings and FIG. 1 in particular, there is shown a pull tab attachment apparatus 10 which essentially comprises a pull tab transport unit 11, a clamper applying unit 12, a clamping unit 13 and a checking unit 14.

Figure 8:
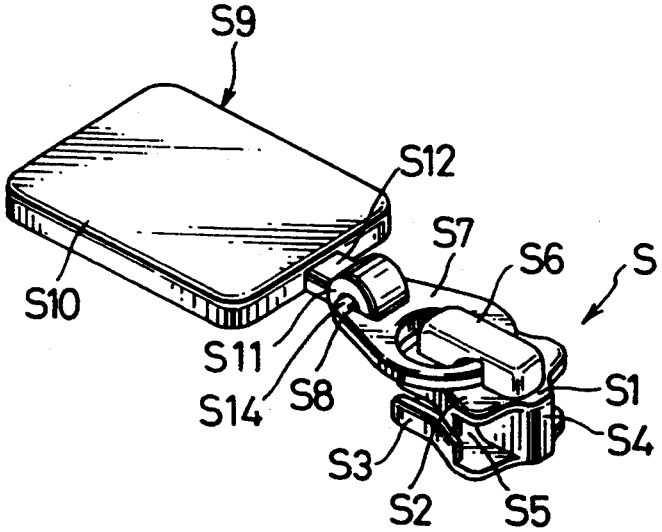
FIG. 8 is a perspective view of a slider shown assembled.

Before going into detailed description of the apparatus 10, a slide fastener slider S to be assembled thereby will be described as to its construction with reference to FIG. 8. The slider S comprises a slider body $S_1$ having an upper wing member $S_2$ and a lower wing member $S_3$ joined together at one end by a head portion or "diamond" $S_4$ to define therebetween a guide channel $S_5$ for the passage therethrough of a pair of slide fastener stringers (not shown), a trunnion $S_6$ formed on the upper wing member $S_2$, a clamper $S_7$ pivotally connected to the trunnion $S_6$ and having an aperture $S_8$ at the opposite distal end $S_{14}$, and a pull tab $S_9$ including a web portion $S_{10}$ and a coupling link $S_{11}$ rotatavely received in the aperture $S_8$ of the clamper $S_7$, the link $S_{11}$ being connected by a neck portion $S_{12}$ to one end of the web portion $S_{10}$. This is only exemplary of one of many different forms of a slider which may be assembled by the apparatus 10 of the invention upon appropriate modification or change to some of its component parts.

The pull tab transport unit 11 comprises a pull tab transfer chute 15 having a pair of elongate horizontal guide rails 16a and 16b defining therebetween a longitudinal guide slit 17 for receiving a series of pull tabs $S_9$. The guide slit 17 is adjustable depending upon the type and size of the pull tab to be applied. Each pull tab $S_9$ is fed from an inlet 18 as mounted in the the slit 17 either manually or automatically with its coupling link $S_{11}$ hooked on the confronting inner longitudinal edges 16a', 16b' of the guide rails 16a, 16b and exposed above the upper surfaces thereof as shown in FIG. 1. The coupling link $S_{11}$ is split apart to provide an opening $S_{13}$ extending parallel with the plane of the web portion $S_{10}$ of the pull tab $S_9$ and with the guide slit 17 for receiving and connecting the clamper $S_7$ of the slider S in a manner hereinafter to be described.

The chute 15 is provided With a plurality of pull tab retainers 19 as designated at 19*a*, 19*b*, 19*c*, 19*d* and 19*e*, respectively, at predetermined intervals along the inner longitudinal edge 16*a'* of one of the guide rails, which is the right-hand side rail 16*a* according to the presently illustrated embodiment in FIG. 1 for normally resiliently holding the link $S_{11}$ of the pull tab $S_9$ against the inner longitudinal edge 16*b'* of the opposed mating rail 16*b*.

The pull tab transport unit 11 includes a transfer conveyor 20 in the form of an elongate horizontal plate and a drive means 21 designed to effect multi-directional movements of the conveyor 20 as indicated by the arrows in FIG. 1 in which the conveyor 20 is reciprocally movable in both longitudinal and transverse directions; i.e, along a rectangular path in a manner hereinafter to be described.

The conveyor 20 is provided at predetermined .intervals along its inner longitudinal edge with a plurality of engaging lugs 22–28 each spaced a predetermined distance apart to register with corresponding working positions in a manner hereafter to be described.

Each of the engaging lugs 22–28 is provided at its inner end with a pocket (not shown) dimensioned and configured to hold the link $S_{11}$ to firmly retain the pull tab $S_9$ against displacement during transport thereof along the chute 15. The multi-directional movement of the conveyor 20 will now be described with reference to FIG. 1.

A first longitudinal forward stroke of the conveyor 20 in the leftward direction as viewed in the drawing causes a first engaging lug 22 to bring the pull tabs $S_9$ one at a time over to a sensing position defined by the first retainer 19*a* at which a sensor 29 detects whether the web S10 of the pull tab $S_9$ is oriented with its front or back side facing the conveyor 20, although such sensor is not always required where both sides of the web $S_{10}$ are identical. The conveyor 20 then makes a short transverse retractive movement toward the drive means 21 away from the guide slit 17 and then moves longitudinally backward in the rightward direction until a second engaging lug 23 registers with the position of the sensor 29, followed by a short transverse ingressive movement toward the guide slit 17 away from the drive means 21 to receive the link $S_{11}$ of the pull tab $S_9$ at the sensor 29 into the second engaging lug 23. This is followed by a second longitudinal forward stroke of the conveyor 20 to transfer the pull tab $S_9$ from the sensor 29 over to a surface invertor 30 at which the web 10 of the pull tab $S_9$ is flipped 180° if dictated to make a surface matching. The conveyor 20 then retracts transversely away from the guide slit 17 and moves longitudinally backward until the third engaging lug 24 registers with the position of the surface invertor 30 and captures the pull tab $S_9$, followed by a third longitudinal forward stroke to bring the pull tab $S_9$ over to a clamper applying position defined by the second retainer 19*b* wherein the pull tab $S_9$ is connected to the slider S in a manner hereafter described. The conveyor 20 then retracts transversely away from the guide slit 17 and moves backward again until the fourth engaging lug 25 registers with the second retainer 19*b* and captures the pull tab $S_9$ as connected with the slider S, followed by a fourth longitudinal forward stroke to bring the combined but unclamped pull tab and slider assembly over to an intermediate position defined by the third retainer 19*c*, followed by a similar transversely retractive and longitudinally backward stroke of the conveyor 20 to bring the unclamped slider by the fifth engaging lug 26 over to a clamping position defined by the fourth retainer 19*d* wherein the link $S_9$ of the pull tab $S_9$ is clamped to close the opening $S_{13}$. This is followed by a similar retractive, backward stroke of the conveyor 20 whereby the clamped slider S is carried by the sixth engaging lug 27 over to a checking unit 14 comprising a clamping detecter 31 for detecting whether or not the slider S has been properly clamped together with the pull tab $S_9$ and a slider body detecter 32 for detecting whether or not the slider body is missing. When the slider S is properly assembled upon detection by the checking unit 14, it is withdrawn by the seventh engaging lug 28 from the machine for storage. If the slider S is found defective at the checking unit 14, the apparatus 10 is shut down for correction of any malfunctioned parts.

The slider and pull tab assembling operation repeats itself as the conveyor 20 makes a longitudinal backward movement to bring the first engaging lug 22 back to the original position at the inlet portion 18 of the chute 15 to receive the next pull tab $S_9$.

Designated at 33 is a horizontally extending slider chute having a guide rail 34 along which a series of pull tab-free sliders S are fed under vibration from a supply hopper (not shown) in a manner well known in the art. Adjacent to an outlet end of the slider chute 33 and above the guide rail 34 is provided a slider transfer means 35 for transferring sliders S in the chute 33 one at a time to a slider holder later described. The slider transfer means 35 comprises a pair of spaced parallel transfer pins 36*a* and 36*b* which are alternately reciprocally vertically movable toward and away from the path of a horizontal row of a sliders S in the chute 33. The first transfer pin 36*a* moves into the chute 33 to receive thereon a leading one of the sliders S, while the second transfer pin 36*b* is retracted from the chute 33 as better shown in FIGS. 2 and 3. The second pin 36*b* moves toward and into the chute 33 to receive the next ensuing slider prior to releasing the leading slider by retractive movement of the first pin 36*a* and then retracts away from the chute 33 to release and relay the next slider onto the first pin 36*a* when the latter has moved again into the chute 33. Thus, alternate reciprocal movement of the two transfer pins 36*a* and 36*b* is timed to effect the delivery of sliders one at a time through the chute 33 to the clamper applying unit 12.

Figure 2:
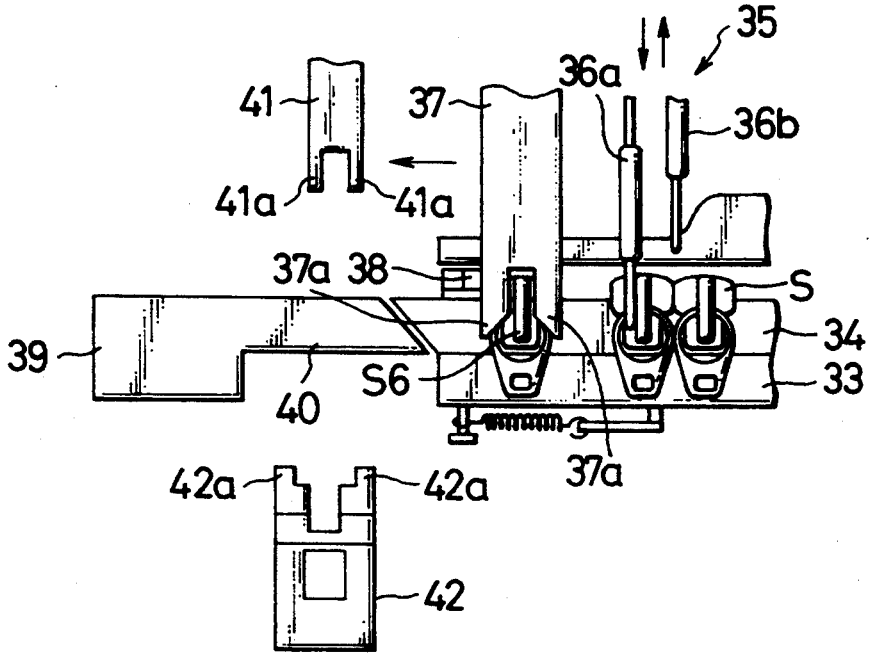
FIG. 2 is a side elevational view of a portion of the same shown in one operative position.

The slider transfer means 35 also includes a slider carriage 37 which is capable of reciprocal horizontal and vertical movement and has a stand-by position above and upstream of a spring-biased slider stopper 38 adapted to releasably arrest a leading one of the sliders S at the outlet end of the slider chute 33. The slider carriage 37 descends from the stand-by position toward the slider chute 33 and captures the leading slider S with its forked pawl 37*a* hooked around the trunnion $S_6$ of the slider S as shown in FIG. 2. The carriage 37 then moves horizontally, carrying the slider S past and downstream of the stopper 38 over to the clamper applying unit 12.

Figure 3:
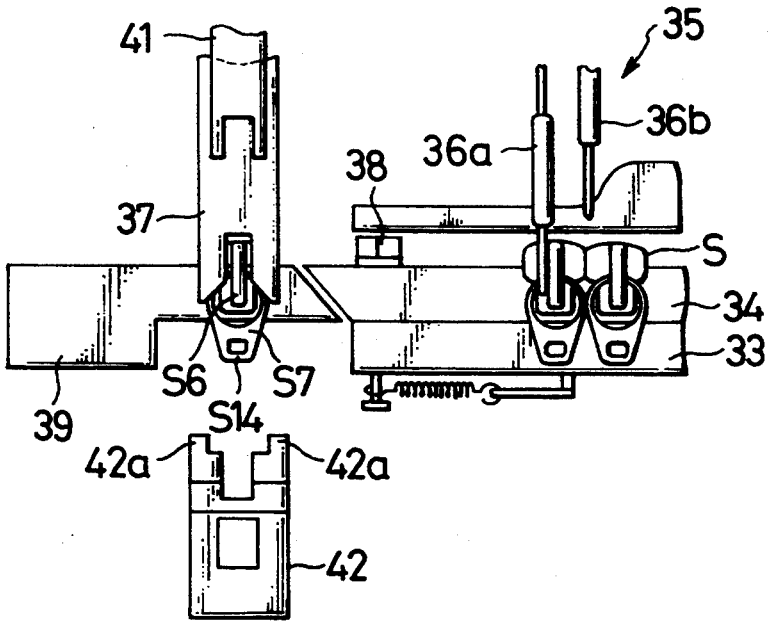
FIG. 3 is a view similar to FIG. 2 but showing the apparatus in another operative position.

The clamper applying unit 12 comprises a vertically movable slider holder 39 having a horizontally extending plate member 40 similar in construction to and registerable end-to-end with the guide rail 34 of the slider chute 33, a clamper guide 41 vertically movable toward and away from the slider holder 39 and having a pair of gripping fingers 41*a*, 41*a* spaced apart to guidedly hold the clamper $S_7$ and a clamper pusher 42 having a pair of spaced abutting fingers 42*a*, 42*a* releasably engageable with the clamper $S_7$ of the slider S. The clamper guide 41 and the clamper pusher 42 are vertically aligned with respect to each other across a clamper set position of the slider holder 39 at which the slider carriage 37 comes to a stop with the slider S mounted thereon as shown in FIG. 3.

Figure 4:
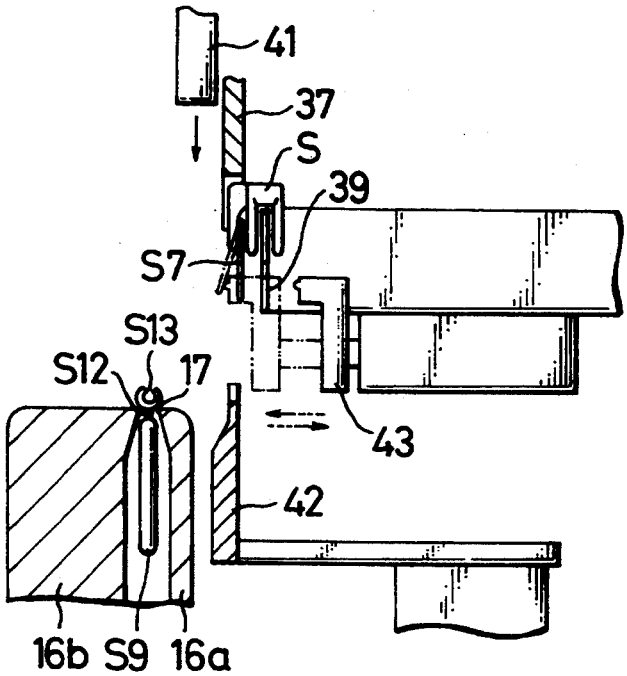
FIGS. 4 through 7 inclusive are side elevational, partly sectional views of another portion of the apparatus showing the operational sequence of a clamper applying unit.
Figure 5:
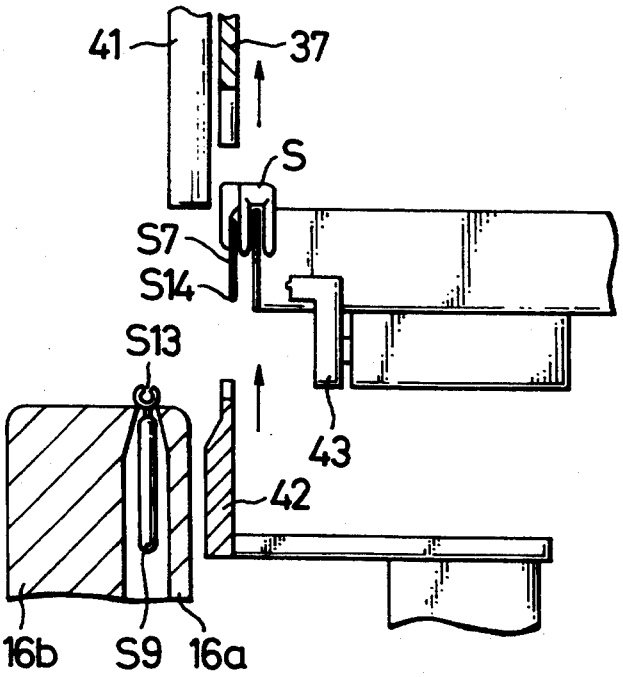
Figure 6:
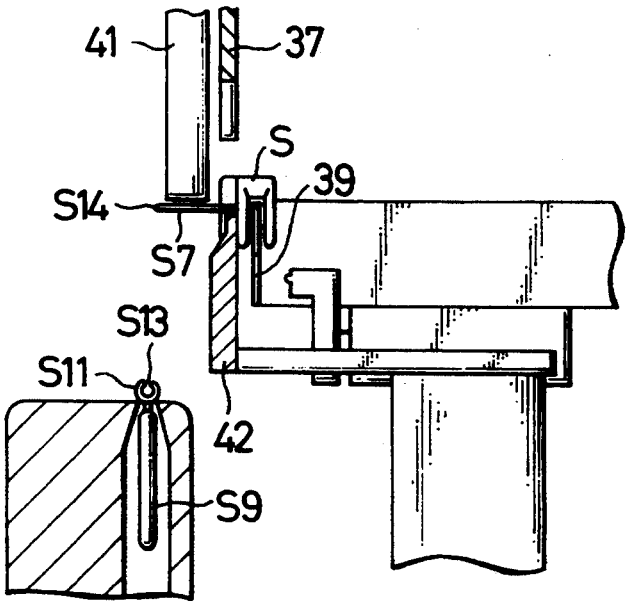
Figure 7:
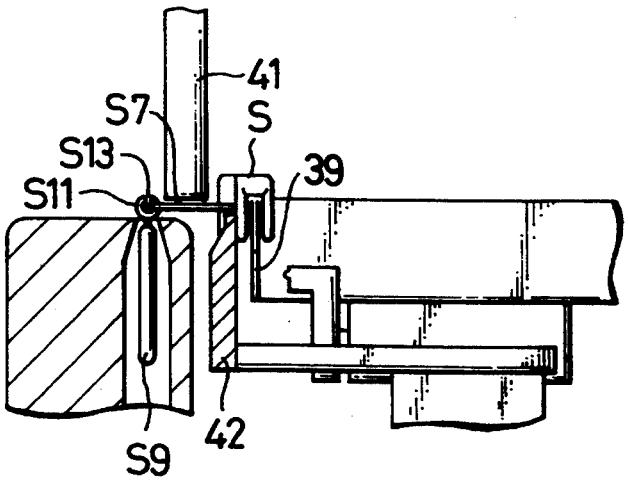

Designated at 43 is a clamper knocker horizontally movable into knocking engagement with the clamper $S_7$ vertically suspending from the slider S on the slider holder 39 so as to ensure free pivotal movement of the clamper $S_7$ relative to the trunnion $S_6$ of the slider S prior to abutting engagement with the clamper pusher 40 as shown in FIG. 4. Thereafter, the clamper guide 41 descends and comes to a stop with its tip end slightly above the pivotal axis of the clamper $S_7$, simultaneously as the slider carriage 37 ascends to release the slider S as shown in FIG. 5. The clamper pusher 42 ascends until its abutting fingers 42*a*, 42*a* enter underneath the clamper $S_7$ which is vertically suspended from the trunnion $S_6$ and lift the clamper $S_7$ pivotally through approximately 90° so that it is oriented to lie substantially horizontally parallel with the upper longitudinal edge of the pull tab chute 15 or the guide slit 17 along which the pull tabs $S_9$ are guidedly fed, in which position of the clamper $S_7$ the distal end S14 thereof is held in alignment with the opening $S_{13}$ in the link $S_{11}$ of the pull tab $S_9$ as shown in FIG. 6. Then, the slider holder 39, the clamper guide 41 and the clamper pusher 42 all simultaneously descend until the clamper $S_7$ is connected to the pull tab $S_9$ in the chute 15 with the distal end $S_{14}$ of the clamper $S_7$ received into the opening $S_{13}$ of the pull tab $S_9$ as shown in FIG. 7, followed by further descending movement of the slider holder 39 and the clamper pusher 42 thereby releasing the slider S as temporarily connected to the pull tab $S_9$ and borne supportedly against the guide rail 16*a* of the chute 15 as illustrated in FIG. 1.

All of the above operative parts of the apparatus 10 associated with the clamper applying unit 12 are actuated by a drive means such as a pneumatically or hydraulically operated cylinder 44.

The slider S and the pull tab $S_9$ temporarily connected as above are advanced by the conveyor 20 to a clamping position defined by the pull tab retainer 19*d* at which the coupling link $S_{11}$ of the pull tab $S_9$ is clamped or clenched to close its opening $S_{13}$ by a clamping punch 13' in the clamping unit 13 in a manner well known in the art. The thus clamped and assembled slider S is further transferred by the conveyor 20 over to the last pull tab retainer 19*e* located at the checking unit 14 where the assembled slider S is checked for defective clamping by the clamping detector 31 and further checked for the presence or absence of the slider body by the slider body detector 32. Upon clearance of these checks, the assembled slider S is withdrawn past the outlet end of the pull tab chute 15.

What is claimed is:

1. A method of attaching a pull tab onto a slider body which comprises the steps of:

(a) feeding a series of pull tabs intermittently one at a time along a horizontal path of travel with an opening in a coupling link of each pull tab oriented to face upward;

(b) feeding a series of unclamped sliders intermittently one at a time along a separate horizontal path of travel above said horizontal path of pull tabs, with a clamper vertically suspended from each slider body;

(c) lifting said clamper pivotally to lie substantially horizontally parallel with respect to the horizontal path of travel of said pull tabs;

(d) connecting said clamper through said link opening to said pull tab;

(e) clamping said slider together with said pull tab by closing said link opening; and (f) withdrawing said clamped slider past the holizontal path of said pull tabs for storage.

2. A method according to claim 1 which further comprises flipping said pull tabs through 180° to assume the same side prior to connection with said sliders.

3. A method according to claim 1 which further comprises detecting said clamped slider for the presence of a slider body and for proper clamping to said pull tab.

4. An apparatus for attaching a pull tab substantially automatically onto a slider body which comprises a pull tab transport unit, a clamper applying unit and a clamping unit; said pull tab transport unit including a pull tab transfer chute having a pair of elongate horizontal guide rails defining therebetween a longitudinal guide slit for receiving a series of pull tabs and a transfer conveyor movable reciprocally along a rectangular path to transfer said pull tabs intermittently one at a time through said chute; said clamper applying unit including a horizontally extending slider supply chute, a slider holder vertically movable toward and away from said pull tab transfer chute, a slider carriage horizontally movable to transfer a series of sliders one at a time over to said slider holder, each of said sliders having a clamper vertically suspended therefrom, and a clamper pusher vertically movable to lift said clamper pivotablly through approximately 90° to lie substantially parallel with said guide slit; and said clamping unit including a clamping punch for clamping the pull tab together with the slider.

5. An apparatus according to claim 4 further including a surface inverter disposed adjacent to the inlet end of said pull tab transfer chute for flipping said pull tabs through 180°.

6. An apparatus according to claim 4 further including a clamper detectors for detecting whether or not the slider has been properly clamped together with the pull tab and a slider body detector for detecting the presence of the slider body as connected with the pull tab, both said detectors and being located adjacent to the outlet end of said slider supply chute.

7. An apparatus according to claim 4 further including a clamper knocker horizontally movable into knocking engagement with the clamper to ensure free pivotal movement thereof relative to the slider body.

* * * * *